US008240242B2

(12) United States Patent
Rys et al.

(10) Patent No.: US 8,240,242 B2
(45) Date of Patent: Aug. 14, 2012

(54) PRESSURIZED ROTARY ACTUATOR

(75) Inventors: Tomek P. Rys, Allen, TX (US); Jason Petermeier, Prosper, TX (US); George Radtke, Frisco, TX (US)

(73) Assignee: Raytheon Company, Waltham, MA (US)

( * ) Notice: Subject to any disclaimer, the term of this patent is extended or adjusted under 35 U.S.C. 154(b) by 781 days.

(21) Appl. No.: 12/329,736

(22) Filed: Dec. 8, 2008

(65) Prior Publication Data

US 2010/0139478 A1 Jun. 10, 2010

(51) Int. Cl.
*F15B 15/12* (2006.01)
*F42B 10/20* (2006.01)

(52) U.S. Cl. ..... 92/122

(58) Field of Classification Search ..... 60/403; 91/392; 92/122, 124, 125
See application file for complete search history.

(56) References Cited

U.S. PATENT DOCUMENTS

| | | | | |
|---|---|---|---|---|
| 3,426,652 | A | 2/1969 | Blake | |
| 7,793,606 | B2 * | 9/2010 | Olivier et al. | 114/245 |

FOREIGN PATENT DOCUMENTS

| | | |
|---|---|---|
| DE | 20210923 | 10/2002 |
| DE | 10156164 | 11/2003 |
| EP | 1 589 233 | 10/2005 |
| EP | 1589233 A1 * | 10/2005 |
| GB | 2 068 463 | 12/1980 |

OTHER PUBLICATIONS

PCT Notification of Transmittal of the International Search Report and the Written Opinion of the International Searching Authority, or the Declaration, International Application No. PCT/US2009/063790, 12 pages, mailing date Feb. 2, 2010.

* cited by examiner

*Primary Examiner* — Thomas E Lazo
(74) *Attorney, Agent, or Firm* — Renner, Otto, Boisselle & Sklar, LLP

(57) ABSTRACT

According to one embodiment, a rotary actuator comprises a chamber within a housing. A piston within the chamber is operable to rotate about a fixed point. A primary inlet is disposed within the housing. The primary inlet allows fluid to pass between the chamber and a primary fluid source.

20 Claims, 4 Drawing Sheets

PRESSURIZED ROTARY ACTUATOR

TECHNICAL FIELD OF THE INVENTION

This invention relates to actuators, and more particularly to a pressurized rotary actuator.

BACKGROUND OF THE INVENTION

An actuator is a mechanical device for moving or controlling a mechanism or system. Actuators may develop force and motion from an available energy source. Actuators are typically used in manufacturing or industrial applications and may be used in things like motors, pumps, switches, and valves.

SUMMARY OF THE INVENTION

According to one embodiment, a rotary actuator comprises a chamber within a housing. A piston within the chamber is operable to rotate about a fixed point. A primary inlet is disposed within the housing. The primary inlet allows fluid to pass between the chamber and a primary fluid source.

Certain embodiments of the invention may provide numerous technical advantages. For example, a technical advantage of one embodiment may include the capability to generate large rotational torque while maintaining a small geometric volume. Other technical advantages of other embodiments may include the capability to deliver large amounts of torque while reducing overall weight. Yet other technical advantages of other embodiments may include the capability to calibrate the amount of torque provided as well as the time to deployment.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of example embodiments of the present invention and its advantages, reference is now made to the following description, taken in conjunction with the accompanying drawings, in which.

DETAILED DESCRIPTION OF EXAMPLE EMBODIMENTS

It should be understood at the outset that, although example implementations of embodiments of the invention are illustrated below, the present invention may be implemented using any number of techniques, whether currently known or not. The present invention should in no way be limited to the example implementations, drawings, and techniques illustrated below. Additionally, the drawings are not necessarily drawn to scale.

Rotary actuators generally provide torsion power to a mechanically-linked component. However, some rotary actuators provide little power relative to the required available space and thus are unable to deliver large amounts of torque in a compact volume. Accordingly, teachings of certain embodiments recognize the use of a pressurized rotary actuator that may generate large rotational torque while maintaining a small geometric volume. Additionally, teachings of certain embodiments recognize that a pressurized rotary actuator with a smaller volume may reduce the overall weight of the device. Furthermore, teachings of certain embodiments recognize that pressurized fluids may aid in calibrating the amount of torque provided as well as the time to deployment.

Figure 1:
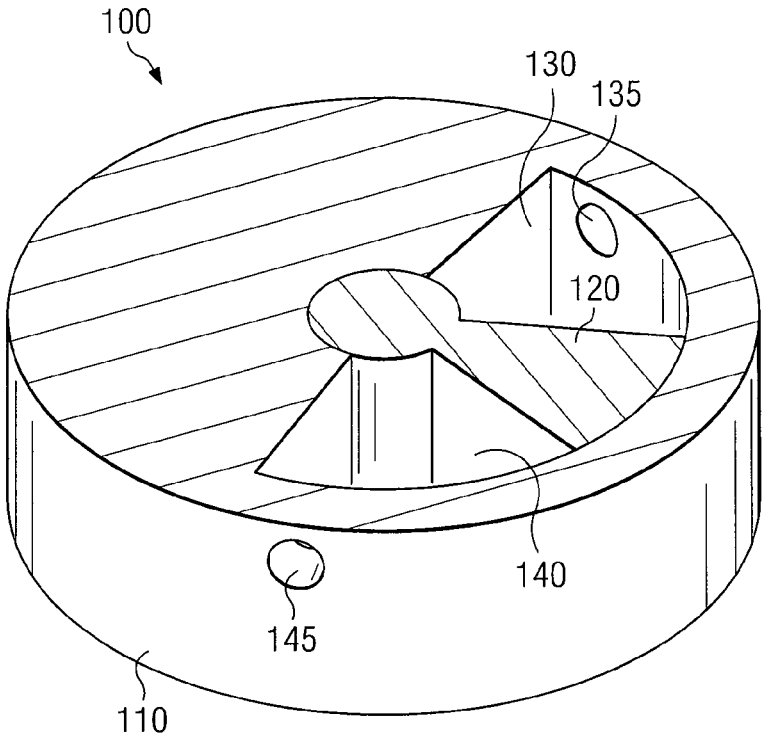
FIGS. 1 and 2 are cross-section perspective views of a rotary actuator according to several embodiments of the invention.
Figure 2:
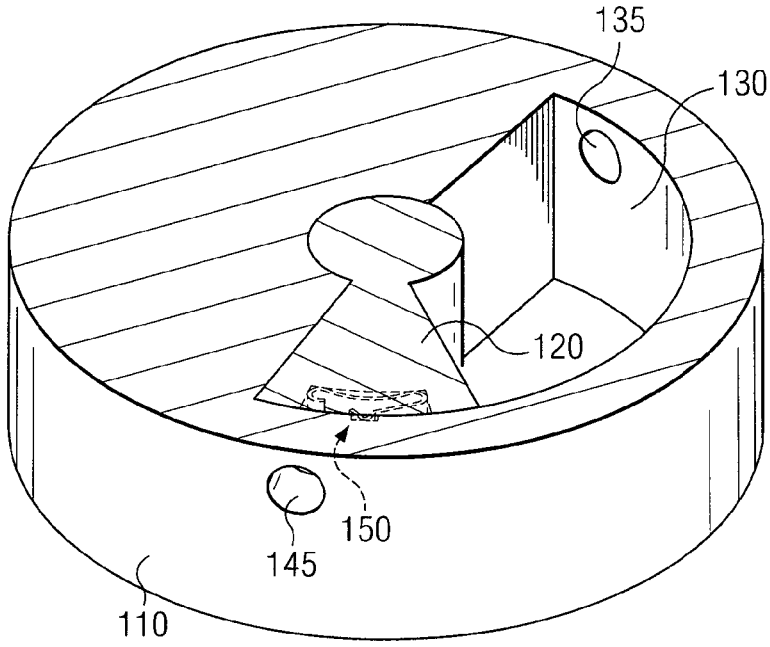

FIGS. 1 and 2 are cross-sectional perspective views of a rotary actuator according to several embodiments of the invention. FIGS. 1 and 2 feature a rotary actuator 100 with a housing 110, a piston 120, an expansion chamber 130, an expansion chamber inlet 135, a damping chamber 140, and a damping chamber inlet 145.

FIG. 1 features a cylindrical housing 110. However, the size, structure, and composition of housing 110 may depend on various design restraints. For example, in some embodiments, expansion chamber 130 and damping chamber 140 may exert strong forces on housing 110; thus, housing 110 may feature thickened or reinforced walls to retain this pressure and may be constructed out of any suitable materials available to retain this pressure. In other embodiments, rotary actuator 110 may fit as a component into a larger structure, and housing 110 may be designed to fit into the available space. In yet other embodiments, the size and dimensions of housing 110 may depend on the required size of piston 120, expansion chamber 130, and damping chamber 140.

Piston 120 separates expansion chamber 130 and damping chamber 140. The size and shape of piston 120, expansion chamber 130, and damping chamber 140 may depend on various design restraints. For example, in the embodiments illustrated in FIGS. 1 and 2, piston 120 is designed to rotate at an angle of less than 180 degrees. Other embodiments may modify the angle at which piston 120 rotates by increasing or decreasing the size of expansion chamber 130 and damping chamber 140 or by increasing or decreasing the width of piston 120.

In some embodiments, expansion chamber 130 may receive fluid through expansion chamber inlet 135. As the pressure inside expansion chamber 130 increases, the fluids inside expansion chamber 130 apply force against piston 120. If the pressure in expansion chamber 130 is greater than the pressure in damping chamber 140, expansion chamber 130 will expand and damping chamber 140 will shrink until the pressures equalize. In other embodiments, a similar result is achieved by releasing fluid out of damping chamber 140 through damping chamber inlet 145.

In some embodiments, damping chamber 140 may be used to control the rate at which piston 120 moves. For example, increasing the pressure in damping chamber 140 may slow the rate at which piston 120 moves. In other embodiments, rotary actuator 100 may incorporate other methods of controlling the rate at which piston 120 moves, such as springs, cushions, shocks, or other devices.

Expansion chamber inlet 135 and damping chamber inlet 145 facilitate the flow of fluid in and out of expansion chamber 130 and damping chamber 140. In some embodiments, inlets 135 and 145 may connect to a stored gas system, such as a pressurized tank for pneumatic or hydraulic operation. As one example, intended for illustrative purpose only, the pressurized tank may include any off-the-shelf pressurized tank, such as a Model 1811-151 Eager-Pak™ Assembly. In some embodiments, inlets 135 and 145 may be connected to separate fluid sources. In other embodiments, inlets 135 and 145 may be connected to the same fluid source and facilitate the transfer of fluid between expansion chamber 130 and damping chamber 140. The fluid sources may be located near rotary actuator 100 or may connect to rotary actuator 100 through a series of pipes, hoses, tubes, or other material capable of facilitating the flow of fluid.

Expansion chamber inlet 135 and damping chamber inlet 145 may be connected to one or more valves operable to control the flow of fluid through the inlets. For example, some embodiments may utilize a solenoid valve for electromechanical control of the fluid flow. Valves may be located near rotary actuator 100 or may connect to rotary actuator 100 through a series of pipes, hoses, tubes, or other material capable of facilitating the flow of fluid.

FIG. 2 illustrates an example embodiment in which expansion chamber 130 is fully expanded and in which damping chamber 140 is collapsed. Embodiments of rotary actuator 100 may reverse the movement of piston 120 either by decreasing the pressure in expansion chamber 130 or by increasing the pressure in damping chamber 140.

Some embodiments may include an additional retentive device 150 to secure piston 120 in a fixed location. For example, in the embodiment illustrated in FIG. 2, expansion chamber 130 fully expanded and eliminated the view of damping chamber 140. An embodiment of rotary actuator 100 may feature an additional retentive device 150 to secure piston 120 in the position illustrated in FIG. 2.

Figure 3A:
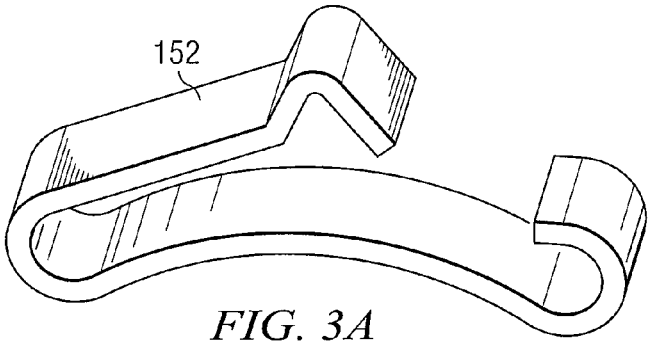
FIGS. 3A, 3B, 3C, and 3D present example retentive devices according to some embodiments of the invention.
Figure 3B:
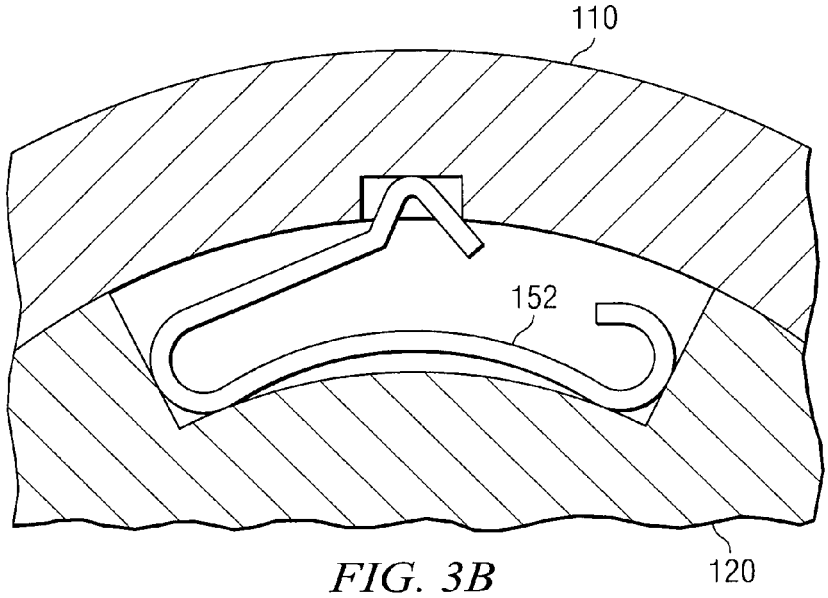
Figure 3C:
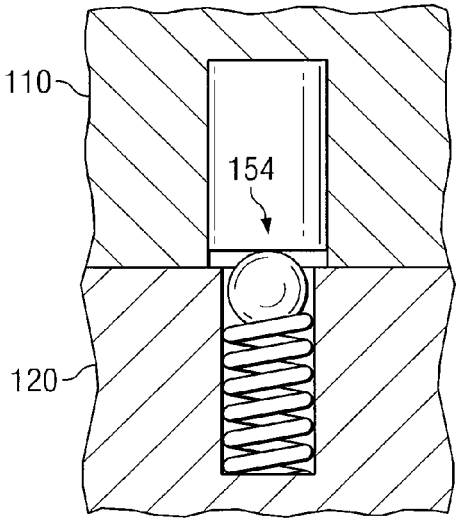
Figure 3D:
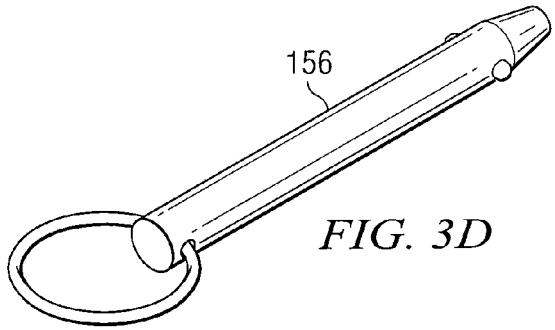

FIGS. 3A, 3B, 3C, and 3D present example retentive devices according to some embodiments of the invention. FIGS. 3A and 3B illustrate a spring detent 152 that fits into a notch in housing 110 and restrains piston 120. FIG. 3C illustrates a ball detent 154 that fits into a notch in housing 110 and restrains piston 120. FIG. 3D presents a locking pin 156 that fits through housing 110 and into a notch in piston 120, restraining piston 120. FIGS. 3A, 3B, 3C, and 3D are only intended to demonstrate examples of a retentive device 150, and the invention is not limited to these three embodiments.

Figure 4:
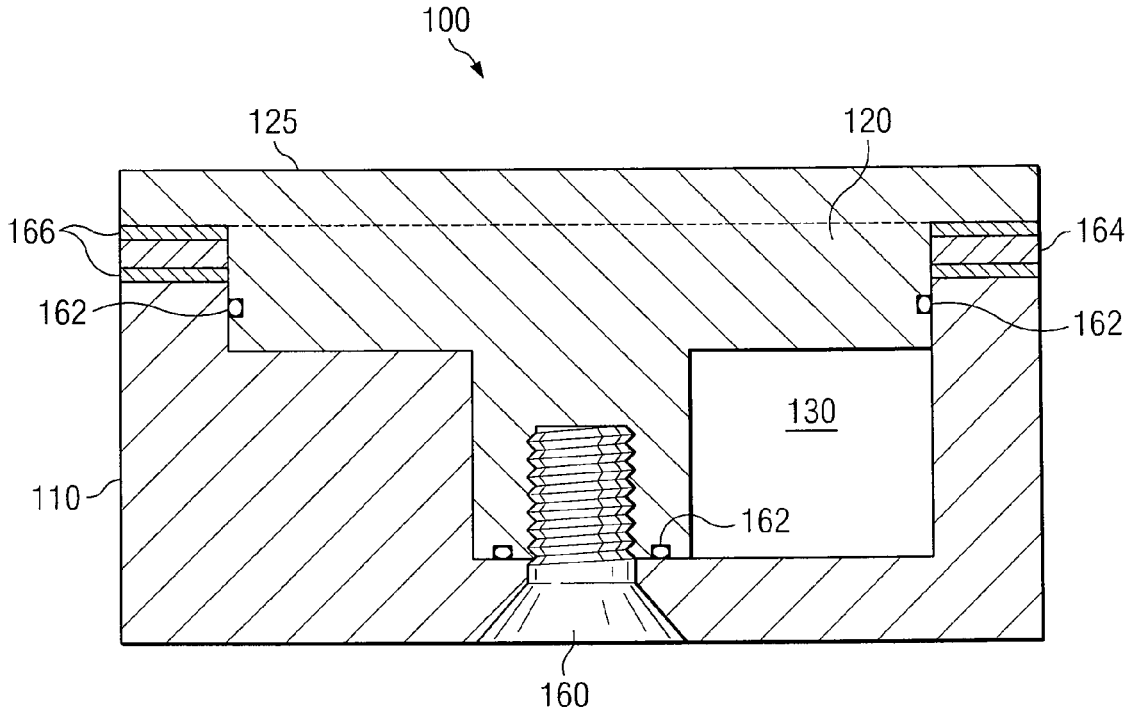
FIG. 4 is a cross-section elevation view of a rotary actuator according to several embodiments of the invention.

FIG. 4 is a cross-section elevation view of a rotary actuator according to several embodiments of the invention. FIG. 4 features a rotary actuator 100 with housing 110, piston 120 with a hub 125, expansion chamber 130, a screw 160, gaskets 162, bearings 164, and washers 166. Piston 120 rotates inside housing 110 about a fixed point. In the embodiment illustrated in FIG. 4, piston 120 rotates around a screw 160. Other embodiments of rotary actuator 100 may include other mechanisms for securing and rotating piston 120 in place of or in addition to screw 160.

In some embodiments, piston 120 will seal against the interior structure of housing 110. For example, some embodiments will include gaskets 162 that fills the space between housing 110 and piston 120 and prevents leakage between expansion chamber 130 and damping chamber 140. In some embodiments, gaskets 162 may include o-rings installed between housing 110 and piston 120. Other embodiments may include components such as washers or flanges in place of or in connection with gaskets 162.

Piston 120 includes a hub 125. Hub 125 forms the top plate of the rotary actuator 100. Hub 125 provides a surface for connecting an object to piston 120. In the embodiment illustrated in FIG. 4, piston 120 and hub 125 are an integrated component of rotary actuator 100. In other embodiments, piston 120 and hub 125 may be separate components.

Hub 125 rotates with piston 120 along the top of rotary actuator 100. In the embodiment illustrated in FIG. 4, rotary actuator 100 includes bearings 164 installed between housing 110 and hub 125. Bearings 164 may include rolling bearings, sliding bearings, or any other suitable bearings. Bearings 164 may also be replaced with other components capable of facilitating the movement of hub 125 across housing 110.

In the embodiment illustrated in FIG. 4, rotary actuator 100 includes washers 166 that distribute the weight of piston 120 and/or hub 125 and seal the connection between housing 110 and hub 125. In some embodiments, washers 166 may also reduce vibration, reduce wear, and prevent corrosion. Some embodiments of washers 166 may include gaskets such as those similar to gaskets 162. In some embodiments, washers 166 may be incorporated into bearings 164.

Figure 5:
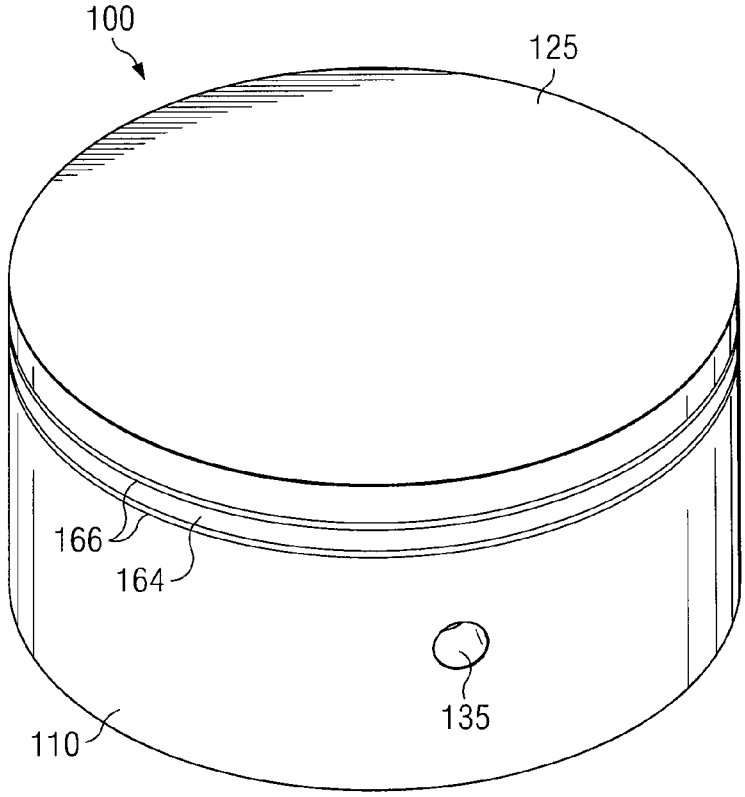
FIG. 5 is a perspective view of the rotary actuator of FIG. 4.

FIG. 5 is a perspective view of the rotary actuator of FIG. 4. FIG. 5 also features housing 110, hub 125, expansion chamber inlet 135, bearings 164, and washers 166. In FIG. 5, rotary actuator 100 includes a cylindrical housing 110 and hub 125. However, other embodiments of rotary actuator 100 may include a non-cylindrical housing 110 and hub 125.

Figure 6:
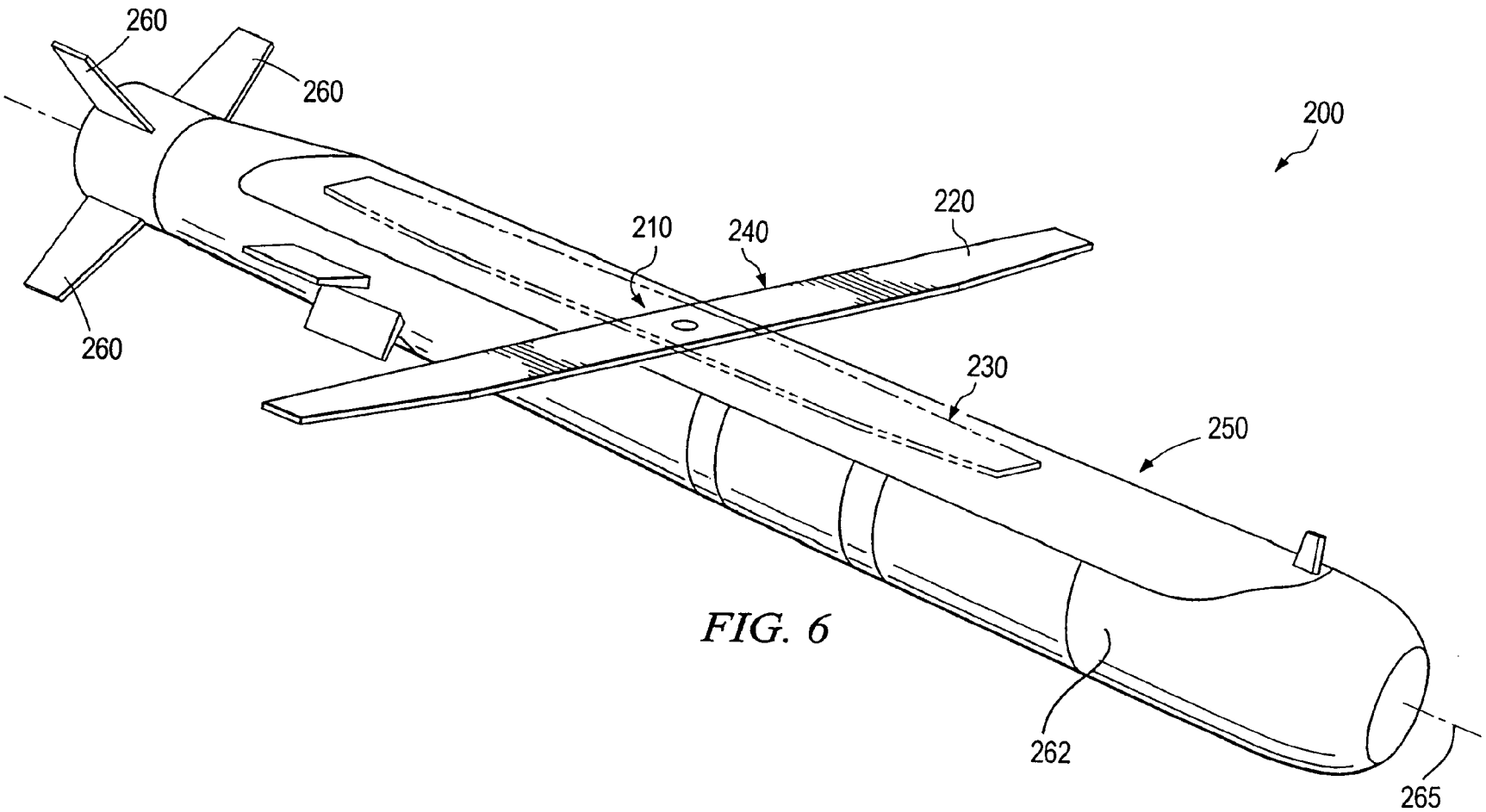
FIG. 6 is a perspective view of an example weapon featuring a rotary actuator according to one embodiment of the invention.

FIG. 6 is a perspective view of an example weapon 200 featuring an example rotary actuator 210 according to one embodiment of the invention. In this example, the rotary actuator 210 rotates a wing 220 between a closed position 230 and an open position 240. In some embodiments, wing 220 may be locked in either the closed position 230 or open position 240 with a retentive device such as retentive device 150.

The weapon 200 includes a fuselage 250, with fins 260 extending from the fuselage 250. The wing 220 is fully outside an external surface 262 of the fuselage, both when the wing 220 is in the closed position 230 and when the wing 220 is in the open position 240. In the closed position 230, the wing 220 is aligned with a longitudinal axis 265 of the weapon 200. In the open position 240 the wing 220 is perpendicular to the longitudinal axis 265.

Teachings of certain embodiments recognize that rotary actuator 210 may provide weapon 200 with large rotational torque in a small geometric volume. However, embodiments of the invention are not limited to the use illustrated in FIG. 6. Rather, FIG. 6 is intended to illustrate just one of the available uses for a rotary actuator according to teachings of the invention.

Although several embodiments have been illustrated and described in detail, it will be recognized that substitutions and alterations are possible without departing from the spirit and scope of the present invention, as defined by the appended claims.

To aid the Patent Office, and any readers of any patent issued on this application in interpreting the claims appended hereto, applicants wish to note that they do not intend any of the appended claims to invoke 6 of 35 U.S.C. §112 as it exists on the date of filing hereof unless the words "means for" or "step for" are explicitly used in the particular claim.

What is claimed is:

1. A rotary actuator comprising:

a housing, wherein the housing defines a chamber within the housing;

a piston within the chamber operable to rotate about a fixed point;

a primary inlet disposed within the housing, the primary inlet allowing fluid to pass between the chamber and a primary fluid source;

a hub attached to the piston, the hub operable to rotate with the piston and seal against the housing; and a wing rigidly connected to the hub and operable to rotate with the hub.

2. The rotary actuator of claim 1, wherein the housing is cylindrical.

3. The rotary actuator of claim 1, wherein the fluid is a pressurized gas.

4. The rotary actuator of claim 1, wherein the fluid is a liquid.

5. The rotary actuator of claim 1, wherein:

the piston divides the chamber into an expansion chamber and a damping chamber; and the primary inlet allows fluid to pass between the expansion chamber and the primary fluid source.

6. The rotary actuator of claim 5, further comprising:

a secondary inlet disposed within the housing, the secondary inlet allowing fluid to pass between the damping chamber and a secondary fluid source.

7. The rotary actuator of claim 6, further comprising a secondary valve operable to control the flow of fluid through the secondary inlet.

8. The rotary actuator of claim 5, wherein the damping chamber applies force against the piston in the direction of the expansion chamber.

9. The rotary actuator of claim 1, further comprising one or more mechanical retentive devices operable to mechanically lock the piston in a fixed position inside the chamber.

10. The rotary actuator of claim 1, further comprising a primary valve operable to control the flow of fluid through the primary inlet.

11. The rotary actuator of claim 1, wherein a roller bearing separates the hub from the housing.

12. The rotary actuator of claim 1, wherein one or more washers or gaskets seals the hub and the housing.

13. The rotary actuator of claim 1, wherein one or more washers or gaskets seals the piston and the chamber.

14. The rotary actuator of claim 1, wherein the rotary actuator is part of a weapon, and is in combination with other parts of the weapon;

wherein the weapon includes a fuselage, and fins extending from the fuselage;

wherein the rotary actuator is in the fuselage of the weapon.

15. The combination of claim 14, wherein the rotary actuator extends the wing from a closed position, with the wing aligned with a longitudinal axis of the weapon, to an open position, with the wing perpendicular to the longitudinal axis, and extending on opposite sides of the fuselage.

16. The combination of claim 15, wherein the wing, when in the closed position, is fully outside of an external surface of the fuselage.

17. The combination of claim 15, wherein the weapon includes a pressurized gas source as the primary fluid source; and wherein the pressurized gas source is operatively coupled to the rotary actuator, to provide pressurized gas to the rotary actuator to rotate the wing from the closed position to the open position.

18. A method of rotating a component, comprising:

providing a rotary actuator comprising:

a housing, wherein the housing defines a chamber within the housing;

a piston within the chamber operable to rotate about a fixed point;

a hub attached to the piston, the hub operable to rotate with the piston and seal against the housing;

attaching a component to the rotary actuator; and injecting a fluid into the chamber such that the piston rotates inside the chamber;

wherein the hub of the rotary actuator is rigidly connected to a wing, the hub operable to rotate the wing from a first position to a second position.

19. The method of claim 18, wherein the housing is cylindrical.

20. The method of claim 18 further comprising locking the piston in a fixed position inside the chamber using a retentive device.

* * * * *